US007237695B2

(12) United States Patent
Dee et al.

(10) Patent No.: US 7,237,695 B2
(45) Date of Patent: Jul. 3, 2007

(54) MECHANICAL GROUTING AND RE-POINTING DEVICE

(76) Inventors: Colin Dee, 11 The Avenue, Coxhoe, Durham, DH6 4AD (GB); Graham Dunn, 8 Broadway Avenue, Trimdon, County Durham, TS29 6PU (GB); Peter Prickett, Great North Road Cottage, Whitesmocks, Durham, DH1 4HN (GB); John Williams, 121 Wallington Road, Billingham, Cleveland, TS23 3XO (GB)

( * ) Notice: Subject to any disclaimer, the term of this patent is extended or adjusted under 35 U.S.C. 154(b) by 281 days.

(21) Appl. No.: 10/867,373

(22) Filed: Jun. 14, 2004

(65) Prior Publication Data

US 2005/0274747 A1 Dec. 15, 2005

(51) Int. Cl.
*B65D 83/00* (2006.01)

(52) U.S. Cl. ..... 222/397; 222/394; 222/399

(58) Field of Classification Search ..... 222/397, 222/394, 399, 386.5, 61
See application file for complete search history.

(56) References Cited

U.S. PATENT DOCUMENTS

| | | | | |
|---|---|---|---|---|
| 1,866,285 | A * | 7/1932 | Albertine | 222/148 |
| 2,603,462 | A * | 7/1952 | Brown et al. | 366/42 |
| 4,431,326 | A * | 2/1984 | Braithwaite et al. | 401/188 R |
| 4,457,642 | A * | 7/1984 | Braithwaite et al. | 401/188 R |
| 4,535,693 | A | 8/1985 | Belvederi | |
| 5,054,658 | A | 10/1991 | Aronie | |
| 5,449,096 | A | 9/1995 | Sedlmeier | |
| 5,772,075 | A * | 6/1998 | Ash et al. | 222/1 |
| 6,216,921 | B1 * | 4/2001 | Spruill | 222/399 |

FOREIGN PATENT DOCUMENTS

| | | |
|---|---|---|
| DE | 296 05 341 | 7/1996 |
| GB | 2011518 | 7/1979 |
| GB | 2049828 | 12/1980 |
| GB | 2267735 | 12/1993 |

* cited by examiner

*Primary Examiner*—Kevin Shaver
*Assistant Examiner*—Stephanie E. Tyler
(74) *Attorney, Agent, or Firm*—MacMillan, Sobanski & Todd, LLC

(57) ABSTRACT

A mechanical grouting and re-pointing device includes a closed pressure vessel for containing grouting or re-pointing material, an input to the pressure vessel for the supply thereto of compressed gas, and an outlet from the pressure vessel to which is attached a nozzle for directing outputted material to the joint to be filled. The device also includes a flow control valve for regulating the flow of compressed gas to the pressure vessel and, as a consequence, for controlling flow of material from the vessel through the nozzle. A manually operated air bleed valve mounted externally of the pressure vessel communicates with the interior of the vessel to control pressure within the vessel.

5 Claims, 3 Drawing Sheets

MECHANICAL GROUTING AND RE-POINTING DEVICE

BACKGROUND OF THE INVENTION

This invention relates to a mechanical re-pointing and grouting device.

Manual re-pointing is a skilled, labor intensive, and slow task that needs a high level of skill to achieve fully filled joints with a satisfactory appearance. When manually re-pointing in the traditional manner, joints are filled from the front by mechanical pressure on the re-pointing material by the brick layer's pointing trowel. To fill to any depth needs a soft re-pointing material because if it is stiff, it cannot be manually pushed into the narrow joint by the pointing trowel. The required soft wet re-pointing material tends to bleed onto the face of the brick, producing an unsatisfactory appearance. Mechanical re-pointing can be much faster, can achieve fully filled joints because they are filled from the back of the joint rather than from the front and, hence, can be much more cost effective. However, the equipment that is currently available has a number of disadvantages.

Grouting is the process of forcing a fluid grouting material into a narrow gap or joint between two surfaces with the intention of completely filling the gap so that when the grouting material has solidified, it will increase the load bearing capacity between the two surfaces and seal the gap or joint. Applications of grouting include the injection of grout material between structural steel work and its supporting concrete base, the injection of grout material between stone work in such applications as harbor walls, embankments etc., the injection of grout material between flagstones, the injection of grout material to support heavy machines and structures, and many more similar applications. Current practice involves either manual methods, which are slow and give results of indeterminate quality, or the application of grout pumping machinery, which is expensive.

There are a number of patented mechanical re-pointing and grouting devices currently available that utilize electrical, hydraulic, or pneumatic power to propel the grouting mix into the joint to be grouted. These devices fall into three types: screw auger; piston; and pressure vessel.

The screw auger device transports the re-pointing or grouting material through a nozzle to the joint being re-pointed or grouted. An electric, pneumatic, or hydraulic motor drives the auger. Screw auger devices are heavy because of the electrical, hydraulic, or pneumatic drive, and they can cause separation of the mix because of the vibration of the rotating auger. Specific grain size material and special plasticizers have to be used to facilitate the flow of the re-pointing or grouting material. Because of the abrasive nature of the re-pointing or grouting material, screw auger devices are subject to wear of the auger, auger housing, and auger bearings. A typical device of this type is described in U.S. Pat. No. 5,054,658.

Piston type devices apply pressure to the re-pointing or grouting material via a piston in a cylinder and force it through a nozzle into the joint. Electrical, pneumatic, hydraulic, or manual drives are used to produce the linear motion of the piston required to force the re-pointing or grouting material into the joint. Piston type devices require a high pressure to operate because of the resistance to flow of the re-pointing or grouting material and friction between the piston and cylinder. They also are subject to piston and cylinder wear because of the abrasive nature of the re-pointing or grouting material, although this can be reduced by incorporating the mixture in a foil bag which is inserted in the cylinder (see, for example, U.S. Pat. No. 5,449,096). A typical piston type device is described in patent German Patent Publication No. 296 05 341.

Pressure vessel type devices (such as shown in British Patent Application No. 2,011,518, and British Patent Application No. 2,267,735) are normally a conical shaped pressure vessel with the apex pointing down and containing the re-pointing or grouting material. A flexible hose or pipe, having a discharge valve and nozzle fitted at one end, is connected at the other end to the cone of the pressure vessel at its lowest point. The pressure vessel is sealed, and compressed air is admitted to the vessel in the space above the re-pointing or grouting material so that it is forced to pass from the vessel through the flexible hose or pipe past the discharge valve and through the nozzle to the joint to be grouted. Some designs (such as shown in British Patent Application No. 2,011,518) admit air to the nozzle to aid the flow of re-pointing or grouting material through the valve.

Due to the high frictional resistance of the re-pointing or grouting material as it passes through the vessel along the discharge pipe and through the discharge valve, the air pressure in the pressure vessel has to be high, requiring it to be strong and, as a result, heavy. Such an air vessel is not easily transported. To overcome difficulties in moving the pressure vessel, some devices use long hoses to enable coverage of a larger area of re-pointing. However, the longer the hose, the greater the friction loss, and the greater the air pressure required in the pressure vessel. The hose or pipe must be of sufficiently large diameter to allow flow of the re-pointing or grouting material, but not too large and heavy with the dense re-pointing or grouting material, to restrict the maneuverability of the nozzle. Also, if the joint to be filled is above the pressure vessel, the air pressure must be increased to overcome this static head. The discharge valve must be designed so that it does not restrict the flow when open, but closes effectively to stop the flow when required. The abrasive nature of the re-pointing or grouting material requires the discharge valve be manufactured from abrasion resistant materials. The hose and discharge valve combination is difficult to clean, and if the mix should solidify and cure before it is removed, then its subsequent removal is likely to lead to damage.

All the devices discussed above have operating, cost, and design problems.

SUMMARY OF THE INVENTION

According to the invention, there is provided a mechanical grouting and re-pointing device as specified in claim 1. In the device, the flow of re-pointing or grouting material into the joint is controlled by metering air into the pressure vessel, rather than metering the re-pointing or grouting material through a discharge valve, as is done in prior art devices. This eliminates the need for a discharge valve and allows the device to operate at an air pressure of less than 2 bar and, hence, the pressure vessel can be of lightweight construction. Air is admitted to the pressure vessel by a standard variable orifice trigger operated valve. It is designed to be readily portable holding approximately 10 kg of re-pointing or grouting material and weighs fully charged less than 15 kilos. Since the nozzle attachment pipe or hose is of short length, less than 100 mm, the friction losses are minimized. The orientation of the changeable nozzle can be adjusted to suit the joint being filled.

To allow safe release of the lid of the pressure vessel, there is a constant air bleed orifice in the lid to release the residual air pressure within the vessel if the lid should require to be removed before all the re-pointing or grouting mix is ejected from the device.

To allow for variations in the re-pointing or grouting material viscosity, there is a manually operated air bleed valve to enable accurate control of the flow rate.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
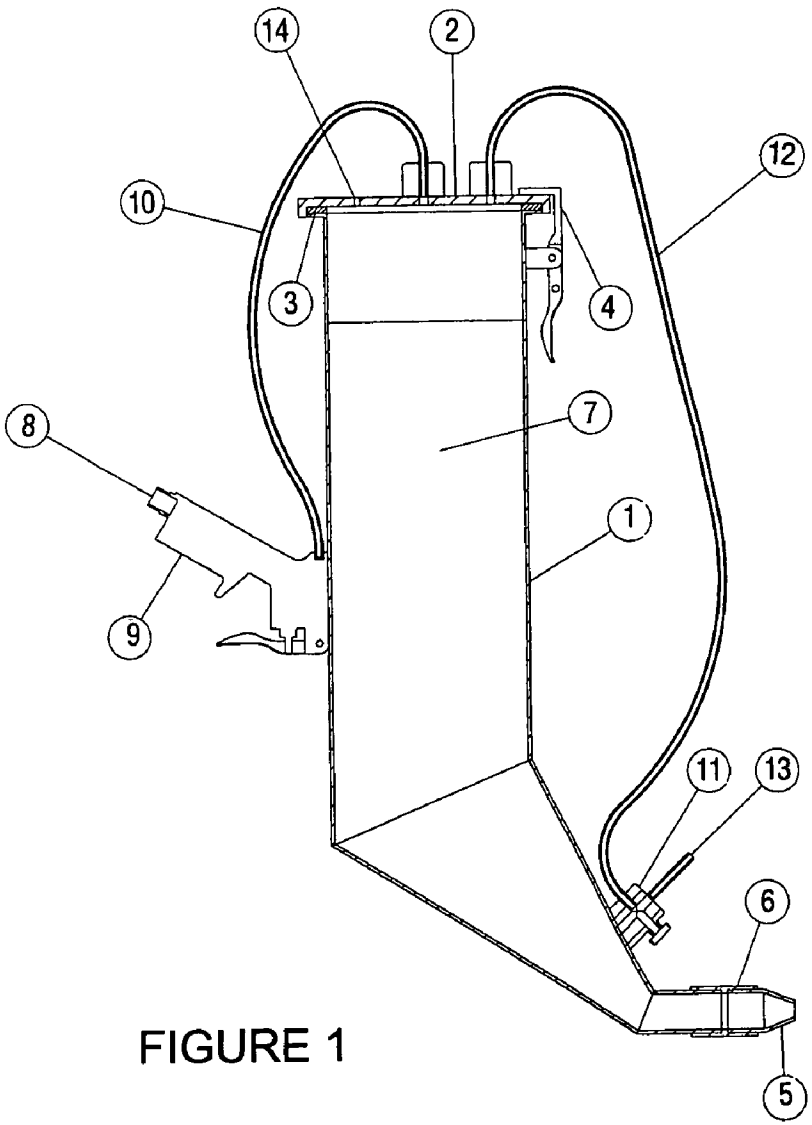
FIG. 1 shows a portable device filled with re-pointing or grouting material.

Referring to FIG. 1, the device comprises a chamber 1 made from a suitable material to which is attached a lid 2 with a seal 3 sealing between the chamber 1 and lid 2. The lid 2 is attached to the chamber 1 by means of a quick release mechanism 4.

A nozzle 5 of appropriate size and shape for the joint to be filled (not shown) is attached to the chamber 1 by means of a connector 6. The connector 6 allows the nozzle 5 to be oriented to the appropriate angle for filling the joint (not shown) while maintaining the chamber 1 at a semi-vertical working position.

A suitable quantity of re-pointing or grouting material 7 is introduced into the chamber 1. The lid 2 is attached and clamped by the quick release mechanism 4, thus effecting an airtight seal. The re-pointing or grouting material 7 acts as a seal preventing air from escaping from the chamber 1 through the nozzle 5 until all the re-pointing or grouting material 7 has been ejected into the joint to be filled (not shown). To achieve this, a regulated compressed air supply from an air compressor (see FIG. 2) or a pressurized air container (see FIG. 3), is admitted to the chamber 1 at the entry 8 to the trigger operated air valve 9 and flexible pipe 10. The air pressure within the chamber 1 above the re-pointing or grouting material 7 is raised sufficiently to cause it to flow though the connector 6 and nozzle 5 into the joint to be filled (not shown). Initiating the re-pointing or grouting material 7 flow requires a higher air pressure than necessary to sustain the flow, due to the properties of the commonly used re-pointing or grouting materials 7. To accommodate this and to allow for different flow characteristics of the re-pointing or grouting material 7 over time, a manually operated air bleed valve 11 is provided. This bleeds air from the chamber 1 via the flexible air bleed pipe 12 to the atmosphere 13.

To allow safe release of the lid 2 from the chamber 1 using the quick release mechanism 4, there is an air bleed hole 14 in the lid 2 to release the residual air pressure within the chamber 1 if the lid 2 should require to be removed before all the re-pointing or grouting mix is ejected from the device.

The chamber 1 can be of a size suitable for the job being undertaken, but will typically be such that the total weight of the device can be handled safely by an operator.

Figure 2:
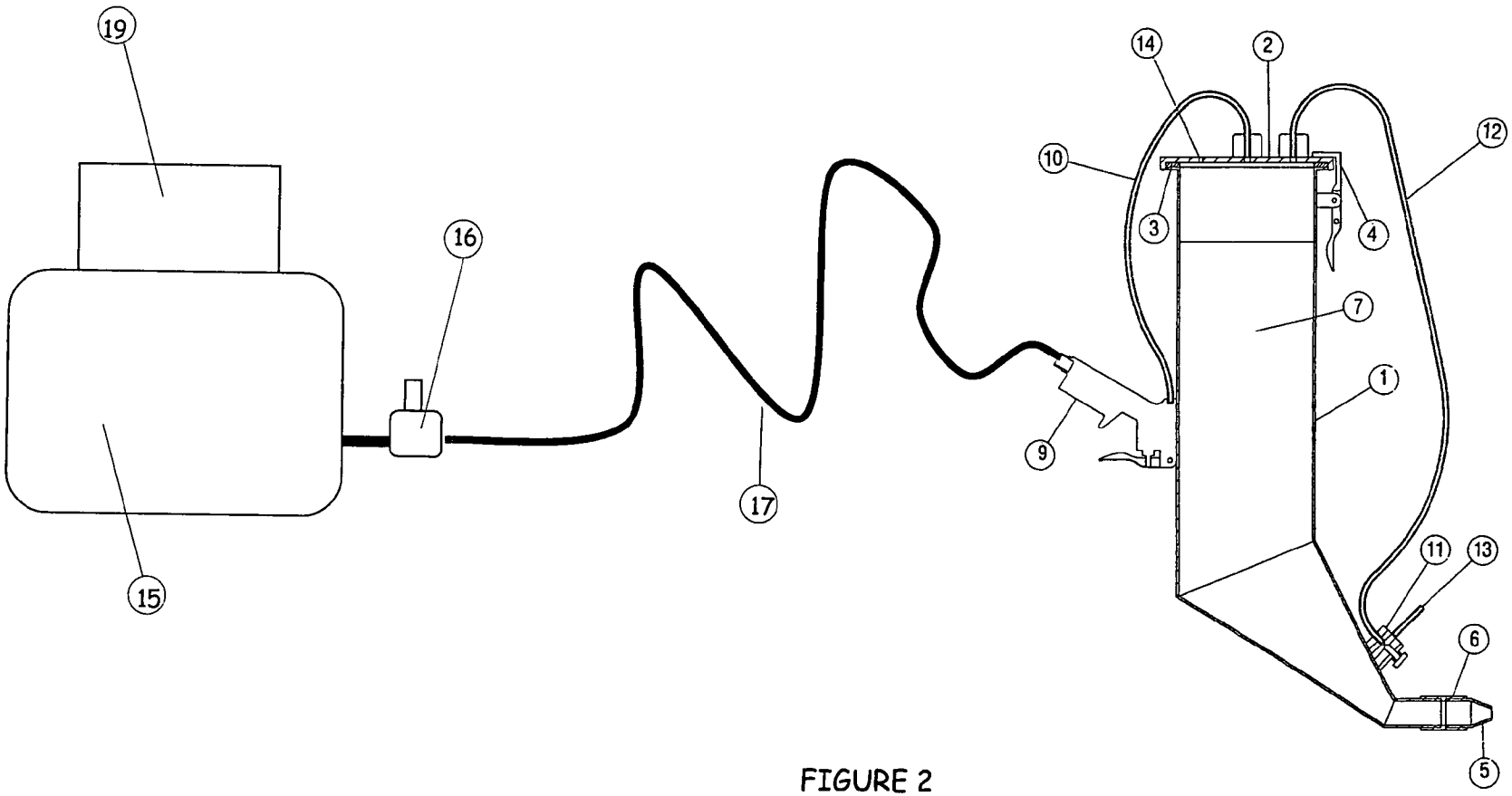
FIG. 2 shows the portable device illustrated in FIG. 1 connected to an air compressor.
Figure 3:
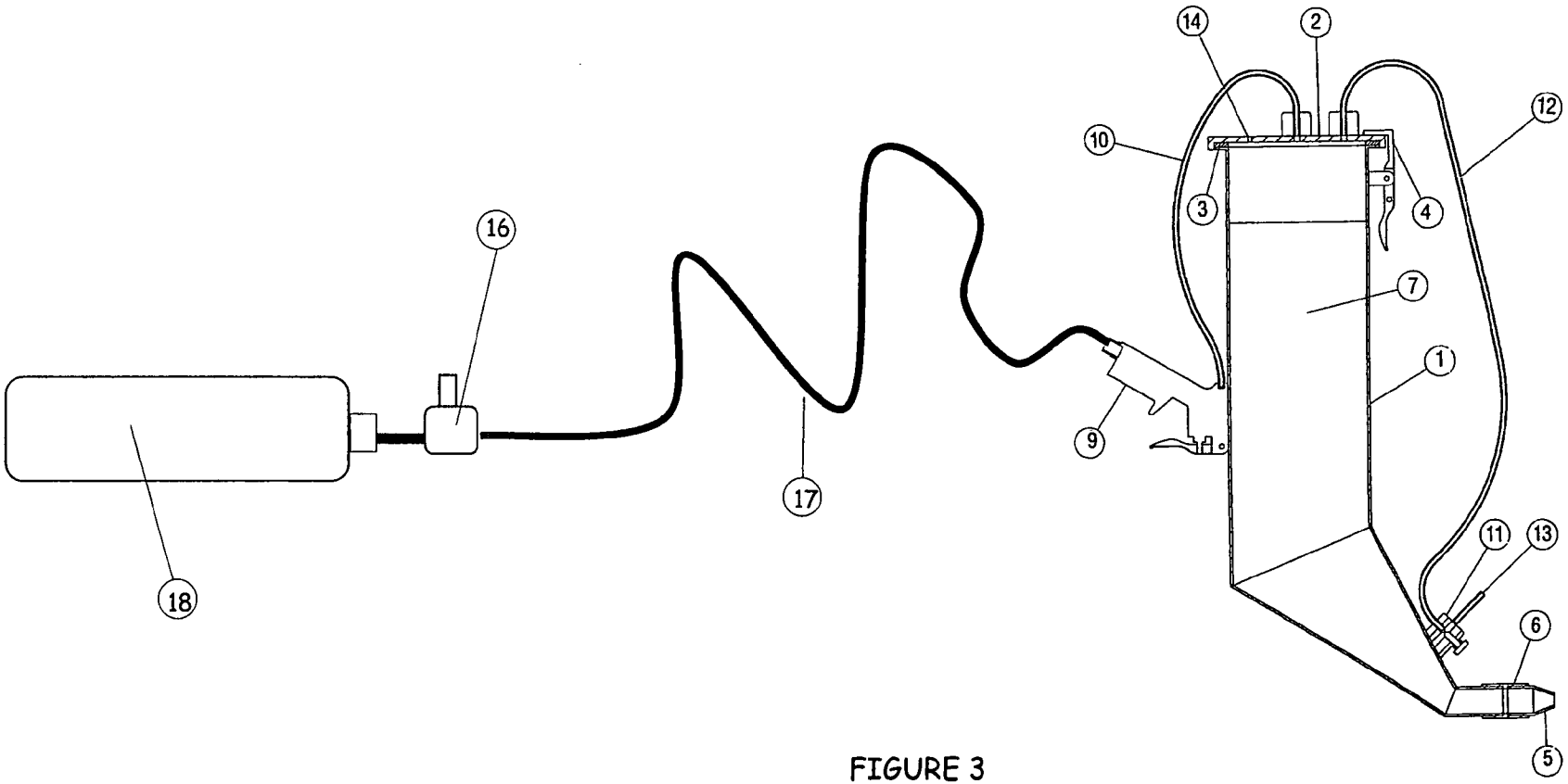
FIG. 3 shows the portable device illustrated in FIG. 1 connected to a compressed air cylinder.

Since the volume of air consumed by the device is small (the volume of the chamber 1 plus a small amount of air bleed through the constant air bleed hole 14 and the screw operated variable bleed valve 11), the air supply can be either an air compressor as shown in FIG. 2, or a pressurized air container as shown in FIG. 3. This enables the device to be used in a wide variety of applications including under water.

A variety of connectors 5 and nozzles 6 can be used to suit various situations. Connector 5, which attaches the nozzle 6 to the chamber 1, can be made from metal, rubber, or plastic and is designed to allow the chamber 1 to be maintained in its semi-vertical working position while allowing the nozzle 6 to be inserted into the cavity to be grouted or pointed. Nozzles 6 are typically made from metal, rubber, or plastic and are designed to suit the shape of cavity being pointed or grouted.

Referring now to FIG. 2, the trigger operated air valve 9 is connected to a source of compressed air by means of an air supply hose 17 and an air pressure regulator 16. The source of compressed air comprises an air storage vessel 15 supplied by a compressor 19.

In FIG. 3, the trigger operated air valve 9 is connected to a source of compressed air by means of an air supply hose 17 and an air regulator 16. In this case, the source of compressed air is a compressed air cylinder 18.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A mechanical grouting and re-pointing device comprising:

a closed pressure vessel for containing grouting or re-pointing material;

an input to the pressure vessel for the supply thereto of compressed gas;

an outlet from the pressure vessel to which is attached a nozzle for directing outputted material to the joint to be filled;

a flow control valve supported on the closed pressure vessel for metering the flow of compressed gas to the pressure vessel, and, as a consequence, for controlling flow of material from the vessel through the nozzle; and a manually operated air bleed valve mounted externally of the pressure vessel and in communication with the interior of the vessel to control pressure within the vessel.

2. A device as claimed in claim 1 wherein the flow control valve comprises a variable orifice, trigger-operated valve.

3. A device as claimed in claim 1 wherein the position of the nozzle is adjustable relative to the pressure vessel.

4. A device as claimed in claim 1 wherein the pressure vessel includes a lid attached thereto by a quick release mechanism.

5. A device as claimed in claim 4 wherein the lid includes a constant bleed orifice therein.

* * * * *